United States Patent [19]

Kenigson

[11] 4,120,102

[45] Oct. 17, 1978

[54] HEEL PAD WITH RADIAL RIBS

[76] Inventor: Robert H. Kenigson, 601 Pisces La., Foster City, Calif. 94409

[21] Appl. No.: 789,510

[22] Filed: Apr. 21, 1977

[51] Int. Cl.[2] ..... A43B 19/00; A43B 21/32; A43B 7/24

[52] U.S. Cl. ..... 36/71; 36/37; 36/59 C; 128/583

[58] Field of Search ..... 36/71, 37, 35 R, 59 C; 128/583, 584, 585

[56] References Cited

U.S. PATENT DOCUMENTS

| | | | |
|---|---|---|---|
| 1,440,060 | 12/1922 | Conger | 36/59 C |
| 1,456,843 | 5/1923 | Clark | 36/37 |
| 3,532,098 | 10/1970 | Rodenberger | 128/583 |

FOREIGN PATENT DOCUMENTS

| | | | |
|---|---|---|---|
| 724,188 | 1/1932 | France | 36/37 |
| 382,819 | 10/1923 | Fed. Rep. of Germany | 36/37 |

*Primary Examiner*—James Kee Chi
*Attorney, Agent, or Firm*—Julian Caplan

[57] ABSTRACT

An insert to fit inside a shoe below the heel of the foot is a pad of resilient material such as artificial rubber. The top surface of the pad is smooth. The under surface has a plurality of ribs which extend out from a center area under the middle of the heel. Each rib has one vertical edge and one slanted edge. The directions in which the slanted edges are disposed is opposite for the left and right shoes and is such that the pressure of the heel and the shape of the ribs tends to rotate or twist the heel around and outward – i.e., away from the other foot — causing the arch to be raised. This promotes foot comfort and reduces wear of the shoe, particularly on the inside edge of the heel.

5 Claims, 5 Drawing Figures

HEEL PAD WITH RADIAL RIBS

This invention relates to a new and improved heel pad for shoes with radial ribs. More particularly, the invention relates to a pad having the structure and characteristics set forth in the Abstract of this application.

A principal purpose of the invention is to improve the comfort of the shoe by at least two means. In the first place, the pad is of a resilient material which cushions the heel of the wearer and provides for ordinary shoes the benefits of crepe rubber soles or other resilient materials. Secondly, the function of the ribs hereinafter described is that the weight of the wearer on the pad causes deformation of the ribs and the shape of the edges of the ribs causes the heel to twist outwardly or around (i.e., away from the opposite foot). This overcomes a common difficulty that shoes tend to twist inward. Twisting outward raises the arch of the wearer's foot, a desirable means for reducing fatigue. Also, the position of the foot in the shoe is improved, reducing the tendency of the foot to wear against the inside of the shoe and thereby reducing the tendency for corns and bunions.

Another result of use of the pad is to eliminate the need for the arch supports frequently worn by people having foot ailments.

Still another advantage of the invention is the reduction in the wear of the shoe, particularly uneven wear of the heel. This reduces the frequency of shoe repair and prolongs the life of the shoe.

The pad promotes walking on the outside edge of the foot which is considered beneficial in that it tends to strengthen the muscles of the foot and leg and reduce fatigue.

Other objects of the present invention will become apparent upon reading the following specification and referring to the accompanying drawings in which similar characters of reference represent corresponding parts in each of the several views.

Figure 1:
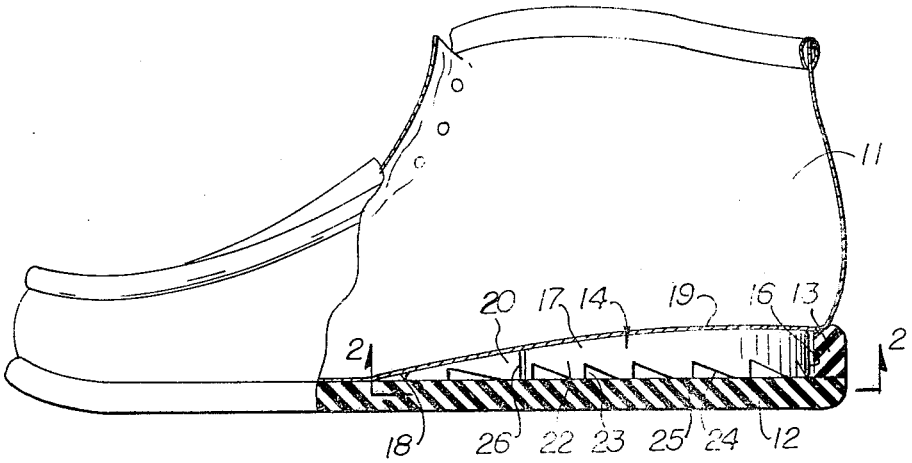
FIG. 1 is a side elevational view of a right shoe broken away in section to show the pad of the present invention installed therein.
Figure 2:
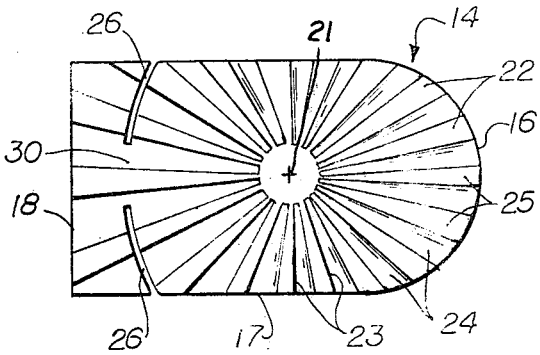
FIG. 2 is a bottom plan view of the pad as viewed substantially along the line 2—2 of FIG. 1.

The present invention may be installed in a shoe 11 of any type. As shown in FIG. 1, the shoe 11 has a sole 12 without a separate heel but such illustration is merely for convenience and the device of the present invention may be used in a dress shoe as well as in the shoe shown. Immediately forward of the back 13 of the shoe is the pad 14. Pad 14 is preferably made of a resilient artificial rubber of the consistency of crepe soles frequently used on leisure shoes or other resilient material. The back edge 16 of the pad 14 conforms to the shape of the back 13 of shoe 11. The side edges 17 in the form of the invention shown in FIGS. 1 and 2 are straight and the forward edge 18 may be perpendicular to the edges 17. Directing attention to FIG. 1, the pad 14 tapers downward in a ramp portion 20 adjacent forward edge 18, and the forward edge 18 is positioned approximately under the arch of the foot of the wearer. A fabric 19 may be used as a liner on the top surface of the pad 14 or may be eliminated if desired.

Extending outward from a central area 21 which is under the middle of the heel of the wearer is a plurality of radial ribs 22. These ribs 22 are cut into the underside of the pad 14 approximately one-third the thickness of the pad. Each rib 22 has a vertical edge 23 on one side and a slanted edge 24 on the opposite side and, in a preferred embodiment, there is a bottom surface 25 between the two sides. In said preferred embodiment, the angle between the vertical edge of one rib and the slanted edge of the adjacent rib is about 60°. In the preferred embodiment, the width of each rib expands proceeding outward from center 21, although the widths may be substantially uniform proceeding outwardly. The direction of the slanted surfaces 24 is different for the left and right foot, the direction of the slant being such that when the weight of the wearer causes compression of the pad 14 the ribs 22 flex, causing the vertical surfaces 23 to slant slightly to promote the twisting action heretofore explained.

Directing attention to FIGS. 1 and 2, optionally, two arcuate cuts 26 may be cut into the pad 14 of approximately the same radius and the same distance from the center 21 as the rear edge 16. The cuts 26 terminate to provide in the middle a neck 30 which connects the portion of the pad 14 forward of the cuts 26 to the portion to the rear thereof.

Figure 3:
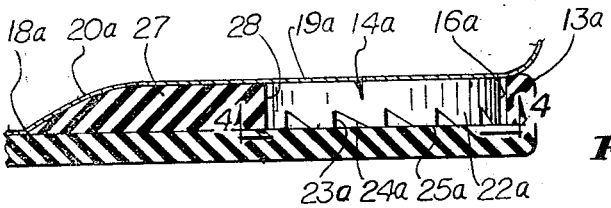
FIG. 3 is a view similar to FIG. 1 of a modification.
Figure 4:
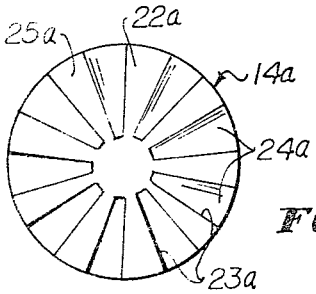
FIG. 4 is a bottom plan view of the circular portion of the pad of FIG. 3 as viewed along the line 4—4 of FIG. 3.

FIGS. 3 and 4 illustrate a modification wherein the pad **14*a* is circular and a forward portion 27 is separated from the portion 14*a* by a complementary arcuate separation 28**.

Figure 5:
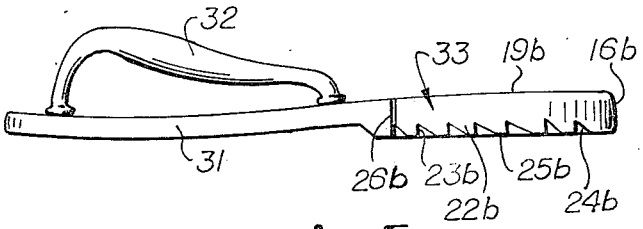
FIG. 5 is a view similar to FIG. 1 of a sandal constructed in accordance with this invention.

FIG. 5 shows the invention incorporated in foot gear which has a flexible sole 31 such as a sandal, the sole being formed of resilient material. Straps 32 of any style or other means may be used to hold the sole 31 on the foot. The heel 33 resembles in structure the pad 14 of FIGS. 1 and 2 except that the ribs **22*b* are cut into the underside of heel 33**.

In other respects, the modification of FIGS. 3 and 4 and the modification of FIG. 5 resemble that of FIGS. 1 and 2, and the same reference numerals followed by the subscripts *a* and *b*, respectively, are used to designate corresponding parts.

What is claimed is:

1. A removable insert pad shaped and dimensioned to fit inside the heel of a conventional shoe from the back of said shoe to about the beginning of the arch, said pad being formed of a resilient material, the top surface of said pad being smooth, the underside of said pad being formed with a plurality of ribs cut into said underside radiating outward from a position near the middle of the wearer's heel extending out to the margin of said pad, each said rib being deformable under the weight of the wearer's heel to flex in a direction tending to twist the heel from the wearer's opposite foot, the back edge of said pad being rounded to conform to the inside of the back of said shoe, the side edges being parallel to each other and the front edge being transverse to said side edges, the width of said ribs increasing proceeding outwardly from the center of said pad.

2. A pad according to claim 1 in which each said rib has a flat bottom, one approximately vertical edge and one slanted edge, the angle between the vertical edge of one rib and the slanted edge of the adjacent rib being about 60°.

3. A pad according to claim 1 in which the top surface of said pad adjacent its forward edge is formed with a downward slanted ramp.

4. A pad according to claim 1 in which arcuate cuts are formed in said pad extending inward from the side edges and the inner termini of said cuts are spaced apart to provide a neck.

5. A pad according to claim 1 in which said pad is formed of two parts, a circular portion under the heel of the wearer and a second portion forward of the circular portion having an arcuate rear edge of a radius complementary to said circular portion.

* * * * *